US005454843A

United States Patent [19]

Rollin et al.

[11] Patent Number: 5,454,843

[45] Date of Patent: Oct. 3, 1995

[54] REDUCING DEPOSIT FORMATION IN GASOLINE ENGINES

[75] Inventors: Anthony J. Rollin, Midlothian, Va.; William J. Colucci; Isaac L. Smith, both of Baton Rouge, La.

[73] Assignee: Ethyl Corporation, Richmond, Va.

[21] Appl. No.: 204,596

[22] Filed: Mar. 2, 1994

[51] Int. Cl.[6] ..... C10L 1/12; C10L 1/18

[52] U.S. Cl. ..... 44/449; 44/447; 44/448

[58] Field of Search ..... 44/447, 448, 449

[56] References Cited

U.S. PATENT DOCUMENTS

| | | | |
|---|---|---|---|
| 2,922,822 | 1/1960 | Beach | 44/447 |
| 3,838,571 | 6/1968 | Filbey | 44/447 |
| 4,497,721 | 2/1985 | Katayama | 252/56 R |

FOREIGN PATENT DOCUMENTS 288296 10/1988 European Pat. Off. .

943777 12/1963 United Kingdom .

*Primary Examiner*—Ellen M. McAvoy

*Attorney, Agent, or Firm*—Dennis H. Rainear; William H. Thrower

[57] ABSTRACT

The invention relates to overcoming a new deposit problem, namely the formation on injector components and intake valves of gasoline engines of deposits containing a substantial amount of inorganic material along with some organic binder materials. This problem has been traced to the presence of trace amounts of alkali metal salts in the fuel composition, and the invention overcomes the problem by including in such fuels a minor amount of at least one gasoline-soluble complexing agent capable of forming in the gasoline a gasoline-soluble complex with said inorganic alkali metal salt and/or the alkali metal cation thereof. The complexing agents used are selected from crown ethers, aza-crown ethers, polycrown ethers, lariat-crown ethers, cryptands, spherands, and bridged spherands.

34 Claims, No Drawings

REDUCING DEPOSIT FORMATION IN GASOLINE ENGINES

This invention relates to a new problem and means for overcoming the problem. More particularly, this invention relates to and has as its principal object the provision of ways of overcoming a new type of deposit formation in gasoline engines.

Original equipment manufactures of automotive vehicles have recently been experiencing a perplexing deposit problem, namely the formation of a new type of deposits on injector system components of gasoline engines equipped with fuel injectors such as port fuel injectors, solenoid activated injectors, and the like. These deposits differ from the conventional type of deposits that tend to form both in carbureted fuel induction systems and in fuel injection systems of gasoline powered engines. The conventional deposits are gums or other organic residues that are believed to result primarily from the fuel itself or at least constituents thereof. Such deposits can be and have been effectively controlled by use of fuel additives that serve as detergents. A number of such additives are in widespread commercial use in present-day gasolines. Unfortunately, however, gasoline detergent additives are ineffective in controlling this new type of deposits. These new types of deposits adhere tenaciously to fuel induction system components such as poppet valves of port fuel injectors, pintles of other types of fuel injection systems, intake valves, and the like. Such deposits can seriously interfere with proper engine operation.

The new type of deposits has been found to contain a substantial amount of inorganic material along with some organic binder materials. We have found for example that deposits formed on the intake valves of a 2.3 liter gasoline engine operated on an ordinary gasoline composition contained 5.1 wt % of sodium sulfate. Likewise we found that deposits that formed in a multiport fuel injector of a vehicle contained 2.1 wt % of sodium sulfate.

Without desiring to be bound by theoretical considerations, it is believed that these inorganic deposits result from the presence of trace quantities of inorganic salts in gasolines which have been formed from gasoline components (e.g., alkylates) prepared by processes in which acids or acidic materials such as sulfuric acid or hydrogen fluoride are neutralized with certain basic substances such as sodium hydroxide or potassium hydroxide. Such processing is believed to cause metal salts to be carried over into the finished gasoline in trace amounts, perhaps in ionic form in trace amounts of water in the gasoline. While in the past such salts may have been present in gasolines, their presence apparently caused no known problems. However their presence in gasolines used in modern production and prototype engines equipped with fuel injection systems of modern design appears to have caused this new deposit problem. But whatever its precise cause, the new deposit problem can be traced to the presence in the gasoline fuel of trace amounts of alkali metal-containing impurities such as one or more alkali metal salts. Typically, the amounts of such impurities correspond to up to about 10 micrograms of alkali metal per milliliter of the fuel.

In accordance with this invention the foregoing new deposit problem is overcome by providing fuel compositions which comprise a gasoline fuel and a minor amount of at least one gasoline-soluble complexing agent capable of forming in the gasoline a gasoline-soluble complex with an inorganic alkali metal salt and/or the alkali metal cation thereof. The gasoline-soluble complexing agents used pursuant to this invention fall in the categories of (i) crown ethers, (ii) aza-crown ethers, (iii) polycrown ethers, (iv) lariat-crown ethers, (v) cryptands, (vi) spherands, and (vii) bridged spherands. These materials have the property of high specificity for complexation with alkali metals and their inorganic salts in non-polar media. Thus when the complexing agent is added to base fuels containing trace amounts of one or more inorganic alkali metal salts, the binding constant of the complexing agent is sufficiently high as to shift the complexation equilibrium far toward complete complexation so that, for example at least 75%, preferably at least 85%, and most preferably at least 95% of the alkali metal content of the fuel composition is tied up in the form of the gasoline-soluble metal complex.

Crown ethers, aza-crown ethers, polycrown ethers, lariatcrown ethers, cryptands, spherands, and bridged spherands are known compounds. A wide variety of such complexing agents and their methods for their synthesis are reported in the literature. See for example R. M. Izatt, K. Pawlak, J. S. Bradshaw and R. L. Bruening, *Chem. Rev.* 1991, 1721–2085, and all references cited therein, all of which are incorporated herein by reference. Suitable complexing agents for use in the practice of this invention include 18-crown-6, dibenzo-18-crown-6, 4,13-diaza-18-crown-6, N,N'-dibenzyl-4,13-diaza-18-crown-6, N,N'-dipropyl-4,13-diaza-18-crown-6, N,N'-bis(2-hydroxyethyl)-4,13-diaza-18-crown-6, N,N'-bis(2-methoxyethyl)-4,13 -diaza-18crown-6, N,N'-dibenzyl-4,10-diaza-15-crown-5, N,N'-bis(2-methoxyethyl)-4,10-diaza-15-crown-5, spher-24C-1, bridged spher-8, bridged spher-12, bridged spher-15, and similar compounds. The nomenclature for such complexing agents is in accordance with that utilized by R. M. Izatt, K. Pawlak, J. S. Bradshaw and R. L. Bruening, loc. cit.

In another of its embodiments, this invention provides a method of reducing formation of fuel injection system deposits containing inorganic alkali metal salt which comprises supplying as the fuel to said injection system a fuel composition comprised of a gasoline fuel containing a trace amount of alkali metal salt and a minor amount of at least one gasoline-soluble complexing agent capable of forming in the gasoline a gasoline-soluble complex with said inorganic alkali metal salt and/or the alkali metal cation thereof.

A further embodiment of this invention relates to improvements in the production of a gasoline fuel composition. In accordance with this embodiment, in the process of formulating a gasoline comprising at least one fuel component containing an alkali metal-containing impurity in an amount such that the alkali metal content of the finished fuel composition is from about 0.01 to about 10 micrograms per milliliter, the improvement comprises the step of blending into the gasoline fuel composition a minor complexing amount of at least one gasoline-soluble complexing agent capable of forming in the gasoline a gasoline-soluble complex with inorganic alkali metal salt and/or the alkali metal cation thereof.

Yet another embodiment is a fuel composition which comprises gasoline containing at least one gasoline-soluble complexing agent in an amount of up to 200 pounds per thousand barrels, and wherein said complexing agent is selected from the group consisting of crown ethers, aza-crown ethers, polycrown ethers, lariat-crown ethers, cryptands, spherands, and bridged spherands and wherein said complexing agent is capable of forming in the gasoline a gasoline-soluble complex with an inorganic alkali metal salt and/or the alkali metal cation thereof.

In addition to having the ability to form in gasoline a gasoline soluble complex with an inorganic metal salt and/or the alkali metal cation thereof, the complexing agents used in the practice of this invention can also be and in most cases are capable of forming in gasoline complexes with other metals or metal salts as well. Indeed, this is an advantageous feature of this invention. It will be understood, however, that it is essential that the complexing agent be capable of at least complexing alkali metals and/or the salts thereof in gasoline.

The above and other embodiments and features of this invention will become still further apparent from the ensuing description and appended claims.

As noted above, an advantageous feature of this invention is that besides complexing the alkali metals or their salts, the complexing agents used for the most part also have the ability to complex other metallic impurities that may be present in the fuel, such as alkaline earth metals and their salts, and a number of the heavier metals and their salts as well.

The crown ethers, aza-crown ethers, polycrown ethers, lariat-crown ethers, cryptands, spherands, and bridged spherands used in the practice of this invention differ sharply from chelating agents of the type used heretofore as metal deactivators in gasolines in order to form complexes with metallic impurities such as copper. Those chelating agents have little if any ability to form complexes with alkali metals or their salts.

The amount of the complexing agent used in the fuel composition will generally be dependent upon the amount of alkali metal contained in the fuel, and the extent of complexation desired. For most gasolines amounts of the complexing agent of up to 200 pounds per thousand barrels of fuel will suffice. Another way of expressing concentration involves the relationship between the alkali metal content of the fuel and the log of the binding constant of the complexing agent being used. For alkali metal contents in the fuel less than 10 micrograms per milliliter, the log of the binding constant of the complexing agent used should be greater than 4 and preferably greater than 5. Normally, the log of the binding constant need not exceed 20, and typically will be below 15.

In most cases, the alkali metal impurity-containing fuels treated pursuant to this invention will contain in the range of about 0.01 to about 10 micrograms of alkali metal per milliter of fuel. Typically therefore the amount of the complexing agent will fall in the range of about: 0.1 to about 200 pounds per thousand barrels. Adjustments can be made in these proportions whenever deemed necessary or appropriate in relation to the situation at hand.

The gasolines utilized in the practice of this invention can be traditional blends or mixtures of hydrocarbons in the gasoline boiling range, or they can contain oxygenated blending components such as alcohols and/or ethers having suitable boiling temperatures and appropriate fuel solubility, such as methanol, ethanol, methyl tert-butyl ether (MTBE), ethyl tert-butyl ether (ETBE), tert-amyl methyl ether (TAME), and mixed oxygen-containing products formed by "oxygenating" gasolines and/or olefinic hydrocarbons falling in the gasoline boiling range. Thus this invention involves use of gasolines, including the so-called reformulated gasolines which are designed to satisfy various governmental regulations concerning composition of the base fuel itself, componentry used in the fuel, performance criteria, toxicological considerations and/or environmental considerations. The amounts of oxygenated components, detergents, antioxidants, demulsifiers, and the like that are used in the fuels can thus be varied to satisfy any applicable government regulations, provided that in so doing the amounts used do not materially impair the deposit control performance made possible by the practice of this invention. Use in the practice of this invention of gasoline containing one or more fuel-soluble ethers and/or other oxygenates in amounts in the range of up to about 20% by weight, and preferably in the range of about 5 to 15% by weight constitutes a preferred embodiment of this invention. It will be appreciated, of course, that the ethers referred to in this paragraph are separate and distinct from the crown ethers and like complexing agents used pursuant to this invention.

The properties of a typical traditional type hydrocarbonaceous gasoline devoid of any additive or oxygenated blending agent are set forth in the following Table I.

TABLE I

| Property | Test Method | Value |
|---|---|---|
| IBP | ASTM D86 | 30° C. |
| 5% | ASTM D86 | 42° C. |
| 10% | ASTM D86 | 51° C. |
| 20% | ASTM D86 | 60° C. |
| 30% | ASTM D86 | 71° C. |
| 40% | ASTM D86 | 86° C. |
| 50% | ASTM D86 | 103° C. |
| 60% | ASTM D86 | 114° C. |
| 70% | ASTM D86 | 124° C. |
| 80% | ASTM D86 | 140° C. |
| 90% | ASTM D86 | 165° C. |
| 95% | ASTM D86 | 187° C. |
| FBP | ASTM D86 | 222° C. |
| RVP | ASTM D323 | 7.4 psi |
| Sulfur | ASTM D3120 | 199 ppm wt |
| Gravity | ASTM D287 | 54.8° API |
| Oxidation Stability | ASTM D525 | 1440 minutes |
| Gum Content, washed | ASTM D381 | 0.4 mg/100 mL |
| Gum Content, unwashed | ASTM D381 | 2.0 mg/100 mL |

A typical oxygenated base gasoline fuel blend containing 12.8% by volume of methyl tert-butyl ether has the characteristics given in Table II.

TABLE II

| Property | Test Method | Value |
|---|---|---|
| Density at 15° C. | ASTM D4052 | 0.772 kg/L |
| IBP | ASTM D86 | 42° C. |
| 10% | ASTM D86 | 63° C. |
| 50% | ASTM D86 | 106° C. |
| 90% | ASTM D86 | 154° C. |
| FBP | ASTM D86 | 199° C. |
| % Off at 70° C. | ASTM D86 | 16 vol % |
| % Off at 100° C. | ASTM D86 | 45 vol % |
| % Off at 180° C. | ASTM D86 | 98 vol % |
| RON | ASTM D2699/86 | 97.2 |
| MON | ASTM D2700/86 | 86.0 |
| RVP | ASTM D323 | 0.49 bar |
| Sulfur | ASTM D3120 | <0.01% |
| Aromatics | ASTM D1319 | 46.9 vol % |
| Olefins | ASTM D1319 | 2.4 vol % |
| Saturates | ASTM D1319 | 50.8 vol % |

Other components which preferably are used include the following:

Cyclopentadienyl Manganese Tricarbonyl Compounds

Compounds of this type are exceptionally useful for providing combined benefits to the fuel. These compounds have the ability of effectively raising the octane quality of the fuel. In addition, these compounds effectively reduce undesirable tailpipe emissions from the engine. Illustrative cyclopentadienyl manganese tricarbonyl compounds suitable for use in the practice of this invention include such compounds as cyclopentadienyl manganese tricarbonyl, methylcyclopentadienyl manganese tricarbonyl, dimethylcyclopentadienyl manganese tricarbonyl, trimethylcyclopentadienyl manganese tricarbonyl, tetramethylcyclopentadienyl manganese tricarbonyl, pentamethylcyclopentadienyl manganese tricarbonyl, ethylcyclopentadienyl manganese tricarbonyl, diethylcyclopentadienyl manganese tricarbonyl, propylcyclopentadienyl manganese tricarbonyl, isopropylcyclopentadienyl manganese tricarbonyl, tert-butylcyclopentadienyl manganese tricarbonyl, octylcyclopentadienyl manganese tricarbonyl, dodecylcyclopentadienyl manganese tricarbonyl, ethylmethylcyclopentadienyl manganese tricarbonyl, indenyl manganese tricarbonyl, and the like, including mixtures of two or more such compounds. Preferred are the cyclopentadienyl manganese tricarbonyls which are liquid at room temperature such as methylcyclopentadienyl manganese tricarbonyl, ethylcyclopentadienyl manganese tricarbonyl, liquid mixtures of cyclopentadienyl manganese tricarbonyl and methylcyclopentadienyl manganese tricarbonyl, mixtures of methylcyclopentadienyl manganese tricarbonyl and ethylcyclopentadienyl manganese tricarbonyl, etc. Preparation of such compounds is described in the literature, e.g., U.S. 2,818,417.

Detergents

Any of a number of different types of suitable gasoline detergent additives can be included in the gasoline fuel compositions of this invention. These detergents include succinimide detergent/dispersants, long-chain aliphatic polyamines, long-chain Mannich bases, and carbamate detergents.

Desirable succinimide detergent/dispersants for use in gasolines are prepared by a process which comprises reacting an ethylene polyamine such as diethylene triamine or triethylene tetramine with at least one acyclic hydrocarbyl substituted succinic acylating agent. The substituent of such acylating agent is characterized by containing an average of about 50 to about 100 (preferably about 50 to about 90 and more preferably about 64 to about 80) carbon atoms. Additionally, the acylating agent has an acid number in the range of about 0.7 to about 1.3 (e.g., in the range of 0.9 to 1.3, or in the range of 0.7 to 1.1), more preferably in the range of 0.8 to 1.0 or in the range of 1.0 to 1.2, and most preferably about 0.9. The detergent/dispersant contains in its molecular structure in chemically combined form an average of from about 1.5 to about 2.2 (preferably from 1.7 to 1.9 or from 1.9 to 2.1, more preferably from 1.8 to 2.0, and most preferably about 1.8) moles of the acylating agent per mole of said polyamine. The polyamine can be a pure compound or a technical grade of ethylene polyamines which typically are composed of linear, branched and cyclic species.

The acyclic hydrocarbyl substituent of the detergent/dispersant is preferably an alkyl or alkenyl group having the requisite number of carbon atoms as specified above. Alkenyl substituents derived from poly-α-olefin homopolymers or copolymers of appropriate molecular weight (e.g., propene homopolymers, butene homopolymers, $C_3$ and $C_4$ α-olefin copolymers, and the like) are suitable. Most preferably, the substituent is a polyisobutenyl group formed from polyisobutene having a number average molecular weight (as determined by gel permeation chromatography) in the range of 700 to 1200, preferably 900 to 1100, most preferably 940 to 1000. The established manufacturers of such polymeric materials are able to adequately identify the number average molecular weights of their own polymeric materials. Thus in the usual case the nominal number average molecular weight given by the manufacturer of the material can be relied upon with considerable confidence.

Acyclic hydrocarbyl-substituted succinic acid acylating agents and methods for their preparation and use in the formation of succinimide are well known to those skilled in the art and are extensively reported in the patent literature. See for example the following U.S. Patents:

| | | |
|---|---|---|
| 3,018,247 | 3,231,587 | 3,399,141 |
| 3,018,250 | 3,272,746 | 3,401,118 |
| 3,018,291 | 3,287,271 | 3,513,093 |
| 3,172,892 | 3,311,558 | 3,576,743 |
| 3,184,474 | 3,331,776 | 3,578,422 |
| 3,185,704 | 3,341,542 | 3,658,494 |
| 3,194,812 | 3,346,354 | 3,658,495 |
| 3,194,814 | 3,347,645 | 3,912,764 |
| 3,202,678 | 3,361,673 | 4,110,349 |
| 3,215,707 | 3,373,111 | 4,234,435 |
| 3,219,666 | 3,381,022 | 5,071,919 |

Use of fuel-soluble long chain aliphatic polyamines as induction cleanliness additives in distillate fuels is described for example in U.S. Pat. Nos. 3,438,757; 3,454,555; 3,485,601; 3,565,804; 3,573,010; 3,574,576; 3,671,511; 3,746,520; 3,756,793; 3,844,958; 3,852,258; 3,864,098; 3,876,704; 3,884,647; 3,898,056; 3,950,426; 3,960,515; 4,022,589; 4,039,300; 4,128,403; 4,166,726; 4,168,242; 5,034,471; and 5,086,115; and published European Patent Application 384,086.

Use in gasoline of fuel-soluble Mannich base additives formed from a long chain alkyl phenol, formaldehyde (or a formaldehyde precursor thereof), and a polyamine to control induction system deposit formation in internal combustion engines is described for example in U.S. Pat. No. 4,231,759.

Carbamate fuel detergents are compositions which contain polyether and amine groups joined by a carbamate linkage. Typical compounds of this type are described in U.S. Pat. No. 4,270,930. A preferred material of this type is commercially available from Chevron Chemical Company as OGA-480 additive.

Antioxidants Various compounds known for use as oxidation inhibitors can be utilized in the practice of this invention. These include phenolic antioxidants, amine antioxidants, sulfurized phenolic compounds, and organic phosphites, among others. For best results, the antioxidant should be composed predominately or entirely of either (1) a hindered phenol antioxidant such as 2,6-di-tert-butylphenol, 4-methyl-2,6-di-tert-butylphenol, 2,4-di-methyl-6-tert-butylphenol, 4,4'-methylenebis(2,6-di-tert-butylphenol), and mixed methylene bridged polyalkyl phenols, or (2) an aromatic amine antioxidant such as the cycloalkyl-di-lower alkyl amines, and phenylenediamines, or a combination of one or more such phenolic antioxidants with one or more such amine antioxidants. Particularly preferred for use in the practice of this invention are combinations of tertiary butyl phenols, such as 2,6-di-tert-butylphenol, 2,4,6-tri-tert-butylphenol and o-tert-butylphenol. Also useful are N,N'-di-lower-alkyl phenylenediamines, such as N,N'-di-sec-butyl-p-phenylenediamine, and its analogs, as well as combinations of such phenylenediamines and such tertiary butyl phenols.

Demulsifiers

A wide variety of demulsifiers are available for use in the practice of this invention, including, for example, organic sulfonates, polyoxyalkylene glycols, oxyalkylated phenolic resins, and like materials.. Particularly preferred are mixtures of alkylaryl sulfonates, polyoxyalkylene glycols and oxyalkylated alkylphenolic resins, such as are available commercially from Petrolite Corporation under the TOLAD trademark. One such proprietary product, identified as TOLAD 286K, is understood to be a mixture of these components dissolved in a solvent composed of alkyl benzenes. This product has been found efficacious for use in the compositions of this invention. A related product, TOLAD 286, is also suitable. In this case the product apparently contains the same kind of active ingredients dissolved in a solvent composed of heavy aromatic naphtha and isopropanol. However, other known demulsifiers can be used.

Corrosion Inhibitors

Here again, a variety of materials are available for use in the practice of this invention. Thus, use can be made of dimer and trimer acids, such as are produced from tall oil fatty acids, oleic acid, linoleic acid, or the like. Products of this type are currently available from various commercial sources, such as, for example, the dimer and trimer acids sold under the HYSTRENE trademark by the Humko Chemical Division of Witco Chemical Corporation and under the EMPOL trademark by Emery Chemicals. Another useful type of corrosion inhibitor for use in the practice of this invention are the alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having 8 to 24 carbon atoms in the alkenyl group with alcohols such as the polyglycols. Preferred materials are the aminosuccinic acids or derivatives thereof represented by the formula:

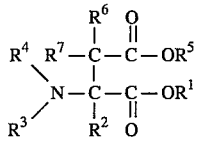

wherein each of $R^1$, $R^2$, $R^5$, $R^6$ and $R^7$ is, independently, a hydrogen atom or a hydrocarbyl group containing 1 to 30 carbon atoms, and wherein each of $R^3$ and $R^4$ is, independently, a hydrogen atom, a hydrocarbyl group containing 1 to 30 carbon atoms, or an acyl group containing from 1 to 30 carbon atoms.

The groups $R^1$, $R^2$, $R^3$, $R^4$, $R^5$, $R^6$ and $R^7$ when in the form of hydrocarbyl groups, can be, for example, alkyl, cycloalkyl or aromatic containing groups. Preferably $R^1$ and $R^5$ are the same or different straight-chain or branched-chain hydrocarbon radicals containing 1–20 carbon atoms. Most preferably, $R^1$ and $R^5$ are saturated hydrocarbon radicals containing 3–6 carbon atoms. $R^2$, either $R^3$ or $R^4$, $R^6$ and $R^7$, when in the form of hydrocarbyl groups, are preferably the same or different straight-chain or branched-chain saturated hydrocarbon radicals. Preferably a dialkyl ester of an aminosuccinic acid is used in which $R^1$ and $R^5$ are the same or different alkyl groups containing 3–6 carbon atoms, $R^2$ is a hydrogen atom, and either $R^3$ or $R^4$ is an alkyl group containing 15–20 carbon atoms or an acyl group which is derived from a saturated or unsaturated carboxylic acid containing 2–10 carbon atoms.

Most preferred is a dialkylester of an aminosuccinic acid of the above formula wherein $R^1$ and $R^5$ are isobutyl, $R^2$ is a hydrogen atom, $R^3$ is octadecyl and/or octadecenyl and $R^4$ is 3-carboxy-1-oxo-2propenyl. In such ester $R^6$ and $R^7$ are most preferably hydrogen atoms.

Metal Deactivators.

If desired, the fuel compositions of this invention may contain a conventional type of metal deactivator of the type having the ability to form complexes with heavy metals such as copper and the like. Typically, the metal deactivators used are gasoline soluble N,N'-disalicylidene-1,2-alkanediamines or N,N'-disalicylidene-1,2-cycloalkanediamines, or mixtures thereof. Examples include N,N'-disalicylidene-1,2-ethanediamine, N,N'-disalicylidene-1,2-propanediamine, N,N'-disalicylidene-1,2-cyclohexanediamine, and N,N''-disalicylidene-N'-methyl-diproppylenetriamine.

The various additives that can be included in the gasoline compositions of this invention are used in conventional amounts. Thus, the amounts of such optional additives are not critical to the practice of this invention. The amounts used in any particular case are sufficient to provide the desired functional property to the fuel composition, and such amounts are well known to those skilled in the art.

The practice of this invention is illustrated by the examples set forth in Table III. In these tabulated examples, the complexing agents ("Agent") used are as follows:

A 18-Crown-6 (18C6-1) with a molecular weight of 264;

B Dibenzo-18-crown-6 ($B_2$18C6-1) with a molecular weight of 368;

C 15-Crown-5 (15C5-1) with a molecular weight of 220;

D [2.2.2]-Cryptand ([2.2.2]-1) with a molecular weight of 376;

E 4,13-Diaza-18-crown-6 ($A_2$-18C-1) with a molecular weight of 262;

F N,N'-Bis(methoxyethyl)-4,13-diaza-18-crown-6($A_2$18C6-14)BiBEL with a molecular weight of 378;

G Benzo-18-crown-6 acrylamide polymer (poly(B18C6)-1) with a molecular weight of 382 for the monomer (See K. Kimura, T. Maeda, T. Shono, *Talanta* 1979, 26, 945-949);

H Spher-24C-3 with a molecular weight of 920;

I Bridged Spher-17 with a molecular weight of 694; and

J $K_2$Phen18C6-1 with a molecular weight of 382.

The code designations enclosed in parentheses for each complexing agent listed above follow the coding system used by R. M. Izatt, K. Pawlak, J. S. Bradshaw and R. L. Bruening, *Chem. Rev.* 1991, 1721–2085. The concentrations of the specified metal ions in the fuel (i.e., $Na^+$, $K^+$ and $Ca^{++}$ are given in terms of micrograms per mL. The treat rates are given in terms of pounds per thousand barrels (ptb) and represent the amount theoretically required to bind 95% of the amount of metal ($Na^+$, $K^+$ and $Ca^{++}$) specified. The footnotes to Table III specify the basis for each of the values of Log K shown. It will be understood that these examples are not intended to limit, do not limit, and should not be construed as limiting the practice of this invention in its generic aspects.

TABLE III

| Example | Agent | Log K | $Na^+$ | $K^+$ | $Ca^{++}$ | Treat Rate, ptb |
|---|---|---|---|---|---|---|
| 1 | A | 6.11[a] | 0.1 | | | 1.75 |
| 2 | A | 6.11[a] | 0.5 | | | 3.28 |
| 3 | A | 6.11[a] | 1.0 | | | 5.19 |
| 4 | A | 11[a] | | 0.1 | | 0.22 |
| 5 | A | 11[a] | | 0.5 | | 1.12 |
| 6 | A | 11[a] | | 1.0 | | 2.25 |
| 7 | A | 5.09[b] | | | 0.1 | 14.51 |
| 8 | A | 5.09[b] | | | 0.5 | 15.39 |
| 9 | A | 5.09[b] | | | 1.0 | 16.48 |
| 10 | B | 5.11[a] | 0.1 | | | 19.56 |
| 11 | B | 5.11[a] | 0.5 | | | 21.69 |
| 12 | B | 5.11[a] | 1.0 | | | 24.35 |
| 13 | B | 7.55[a] | | 0.1 | | 0.38 |
| 14 | B | 7.55[a] | | 0.5 | | 1.64 |
| 15 | B | 7.55[a] | | 1.0 | | 3.20 |
| 16 | C | 5.38[c] | 0.1 | | | 6.43 |
| 17 | C | 5.38[c] | 0.5 | | | 7.70 |
| 18 | C | 5.38[c] | 1.0 | | | 9.29 |
| 19 | C | 5.90[b] | | 0.1 | | 2.03 |
| 20 | C | 5.90[b] | | 0.5 | | 2.78 |
| 21 | C | 5.90[b] | | 1.0 | | 3.72 |
| 22 | D | 10.6[d] | 0.1 | | | 0.54 |

TABLE III-continued

| Example | Agent | Log K | $Na^+$ | $K^+$ | $Ca^{++}$ | Treat Rate, ptb |
|---|---|---|---|---|---|---|
| 23 | D | 10.6[d] | 0.5 | | | 2.72 |
| 24 | D | 10.6[d] | 1.0 | | | 5.45 |
| 25 | D | 13.0[d] | | 0.1 | | 0.32 |
| 26 | D | 13.0[d] | | 0.5 | | 1.60 |
| 27 | D | 13.0[d] | | 1.0 | | 3.20 |
| 28 | E | 4.49[c] | 0.1 | | | 56.84 |
| 29 | E | 4.49[c] | 0.5 | | | 58.36 |
| 30 | E | 4.49[c] | 1.0 | | | 60.26 |
| 31 | E | 4.13[c] | | 0.1 | | 130.0 |
| 32 | E | 4.13[c] | | 0.5 | | 130.0 |
| 33 | E | 4.13[c] | | 1.0 | | 132.0 |
| 34 | F | 4.77[e] | 0.1 | | | 43.30 |
| 35 | F | 4.77[e] | 0.5 | | | 45.49 |
| 36 | F | 4.77[e] | 1.0 | | | 48.22 |
| 37 | F | 5.52[e] | | 0.1 | | 7.92 |
| 38 | F | 5.52[e] | | 0.5 | | 9.21 |
| 39 | F | 5.52[e] | | 1.0 | | 10.82 |
| 40 | F | 4.48[e] | | | 0.1 | 83.67 |
| 41 | F | 4.48[e] | | | 0.5 | 84.93 |
| 42 | F | 4.48[e] | | | 1.0 | 86.50 |
| 43 | G | 6.53[a] | 0.1 | | | 1.30 |
| 44 | G | 6.53[a] | 0.5 | | | 3.52 |
| 45 | G | 6.53[a] | 1.0 | | | 6.28 |
| 46 | G | 8.39[a] | | 0.1 | | 0.34 |
| 47 | G | 8.39[a] | | 0.5 | | 1.64 |
| 48 | G | 8.39[a] | | 1.0 | | 3.26 |
| 49 | H | 9.96[a] | 0.1 | | | 1.33 |
| 50 | H | 9.96[a] | 0.5 | | | 6.66 |
| 51 | H | 9.96[a] | 1.0 | | | 13.33 |
| 52 | H | 10.40[a] | | 0.1 | | 0.78 |
| 53 | H | 10.40[a] | | 0.5 | | 3.92 |
| 54 | H | 10.40[a] | | 1.0 | | 7.84 |
| 55 | I | 11.72[a] | 0.1 | | | 1.00 |
| 56 | I | 11.72[a] | 0.5 | | | 5.03 |
| 57 | I | 11.72[a] | 1.0 | | | 10.05 |
| 58 | I | 12.00[a] | | 0.1 | | 0.59 |
| 59 | I | 12.00[a] | | 0.5 | | 2.96 |
| 60 | I | 12.00[a] | | 1.0 | | 5.91 |
| 61 | J | 6.45[a] | 0.1 | | | 1.46 |
| 62 | J | 6.45[a] | 0.5 | | | 3.67 |
| 63 | J | 6.45[a] | 1.0 | | | 6.44 |
| 64 | J | 7.49[a] | | 0.1 | | 0.41 |
| 65 | J | 7.49[a] | | 0.5 | | 1.71 |
| 66 | J | 7.49[a] | | 1.0 | | 3.34 |
| 67 | J | 7.59[a] | | | 0.1 | 0.38 |
| 68 | J | 7.59[a] | | | 0.5 | 1.65 |
| 69 | J | 7.59[a] | | | 1.0 | 3.24 |

[a]In $CDCl_3$
[b]In EtOH
[c]In MeCN
[d]In $CH_2Cl_2$
[e]In MEOH

Throughout this disclosure, reference is made to various issued patents, patent publications and technical literature. All such documents are incorporated by reference herein in toto as if fully set forth herein.

The term "gasoline soluble" means that the additive material in question can be dissolved in the gasoline fuel being treated to at least the concentration necessary for the material to perform its desired function. Preferably, the additive will have a solubility in excess of this minimum value. However, the term "gasoline soluble" does not mean that the material must be soluble in all proportions in the gasoline fuel composition.

This invention is susceptible to considerable variation in its practice. Accordingly, this invention is not limited to the specific exemplifications set forth hereinabove. Rather, this invention is within the spirit and scope of the appended claims, including the equivalents thereof available as a matter of law.

We claim:

1. A fuel composition which comprises gasoline fuel containing a trace amount of alkali metal salt and a minor amount of at least one gasoline-soluble complexing agent capable of forming in the gasoline a gasoline-soluble complex with said inorganic alkali metal salt and/or the alkali metal cation thereof, said complexing agent being selected from the group consisting of crown ethers, aza-crown ethers, polycrown ethers, lariat-crown ethers, cryptands, spherands and bridged spherands.

2. A composition in accordance with claim 1 wherein the binding constant provided by the complexing agent is sufficiently high so that at least 85% of the alkali metal content of the fuel composition is tied up in the form of the gasoline-soluble complex.

3. A composition in accordance with claim 1 wherein the binding constant provided by the complexing agent is sufficiently high so that at least 95% of the alkali metal content of the fuel composition is tied up in the form of the gasoline-soluble complex.

4. A composition in accordance with claim 1 wherein the complexing agent is at least one crown ether.

5. A composition in accordance with claim 1 wherein the complexing agent is at least one aza-crown ether.

6. A composition in accordance with claim 1 wherein the complexing agent is at least one polycrown ether.

7. A composition in accordance with claim 1 wherein the complexing agent is at least one lariat-crown ether.

8. A composition in accordance with claim 1 wherein the complexing agent is at least one cryptand.

9. A composition in accordance with claim 1 wherein the complexing agent is at least one spherand.

10. A composition in accordance with claim 1 wherein the complexing agent is at least one bridged spherand.

11. A method of reducing formation of fuel injection system deposits containing inorganic alkali metal salt which comprises supplying as the fuel to said injection system a fuel composition comprised of a gasoline fuel containing a trace amount of alkali metal salt and a minor amount of at least one gasoline-soluble complexing agent capable of forming in the gasoline a gasoline-soluble complex with said inorganic alkali metal salt and/or the alkali metal cation thereof, said complexing agent being selected from the group consisting of crown ethers, aza-crown ethers, polycrown ethers, lariat-crown ethers, cryptands, spherands and bridged spherands.

12. A method in accordance with claim 11 wherein the complexing agent is at least one crown ether.

13. A method in accordance with claim 11 wherein the complexing agent is at least one aza-crown ether.

14. A method in accordance with claim 11 wherein the complexing agent is at least one polycrown ether.

15. A method in accordance with claim 11 wherein the complexing agent is at least one lariat-crown ether.

16. A method in accordance with claim 11 wherein the complexing agent is at least one cryptand.

17. A method in accordance with claim 11 wherein the complexing agent is at least one spherand.

18. A method in accordance with claim 11 wherein the complexing agent is at least one bridged spherand.

19. In a method for the production of a gasoline fuel composition comprising at least one fuel component containing an alkali metal-containing impurity in an amount such that the alkali metal content of the finished fuel composition is from about 0.01 to about 10 micrograms per milliliter, the step of blending into the gasoline fuel composition a minor complexing amount of at least one gasoline-soluble complexing agent capable of forming in the gasoline a gasoline-soluble complex with inorganic alkali metal salt and/or the alkali metal cation thereof, said complexing agent being selected from the group consisting of crown ethers, aza-crown ethers, polycrown ethers, lariat-crown ethers, cryptands, spherands and bridged spherands.

20. A method in accordance with claim 19 wherein the complexing agent is at least one crown ether.

21. A method in accordance with claim 19 wherein the complexing agent is at least one aza-crown ether.

22. A method in accordance with claim 19 wherein the complexing agent is at least one polycrown ether.

23. A method in accordance with claim 19 wherein the complexing agent is at least one lariat-crown ether.

24. A method in accordance with claim 19 wherein the complexing agent is at least one cryptand.

25. A method in accordance with claim 19 wherein the complexing agent is at least one spherand.

26. A method in accordance with claim 19 wherein the complexing agent is at least one bridged spherand.

27. A fuel composition which comprises gasoline containing at least one gasoline-soluble complexing agent in an amount of up to 200 pounds per thousand barrels, and wherein said complexing agent is selected from the group consisting of crown ethers, aza-crown ethers, polycrown ethers, lariat-crown ethers, cryptands, spherands, and bridged spherands and wherein said complexing agent is capable of forming in the gasoline a gasoline-soluble complex with an inorganic alkali metal salt and/or the alkali metal cation thereof.

28. A fuel composition in accordance with claim 27 wherein the complexing agent is 18-crown-6.

29. A fuel composition in accordance with claim 27 wherein the complexing agent is [2.2.2]-cryptand.

30. A fuel composition in accordance with claim 27 wherein the complexing agent is benzo-18-crown-6 acrylamide polymer.

31. A fuel composition in accordance with claim 27 wherein the complexing agent is N,N'-bis(methoxyethyl)-4,13-diaza-18-crown-6.

32. A fuel composition in accordance with claim 27 wherein the complexing agent is spher-24C-3.

33. A fuel composition in accordance with claim 27 wherein the complexing agent is bridged spher-17.

34. A fuel composition in accordance with claim 27 wherein the complexing agent is K2phen18C6-1.

* * * * *